US006718577B2

(12) United States Patent
Li

(10) Patent No.: US 6,718,577 B2
(45) Date of Patent: Apr. 13, 2004

(54) VENTILATED BLANKET

(76) Inventor: Hongbiao Li, 1704 Fernwood, Plano, TX (US) 75075

( * ) Notice: Subject to any disclaimer, the term of this patent is extended or adjusted under 35 U.S.C. 154(b) by 0 days.

(21) Appl. No.: 10/234,795

(22) Filed: Sep. 4, 2002

(65) Prior Publication Data

US 2003/0028964 A1 Feb. 13, 2003

Related U.S. Application Data

(63) Continuation-in-part of application No. 09/923,700, filed on Aug. 7, 2001, now Pat. No. 6,457,193.

(51) Int. Cl.[7] ..... A47G 9/00
(52) U.S. Cl. ..... 5/482; 5/486; 5/505.1
(58) Field of Search ..... 5/482, 494, 498, 5/504.1, 505.1, 506.1, 486; 128/872

(56) References Cited

U.S. PATENT DOCUMENTS 739,682 A * 9/1903 Kahl ..... 5/498
1,130,781 A * 3/1915 Wiley ..... 5/498
2,284,448 A * 5/1942 Reinholz ..... 128/872
2,722,694 A * 11/1955 Bryant ..... 128/872
2,808,596 A * 10/1957 Schreiner ..... 5/486
3,199,123 A * 8/1965 Komiske ..... 5/502
3,325,832 A * 6/1967 Malicki ..... 5/487
3,696,450 A * 10/1972 Dupler ..... 5/486
3,840,923 A * 10/1974 Bos ..... 5/499
4,975,997 A * 12/1990 Misiura et al. ..... 5/505.1
5,181,287 A * 1/1993 Jun-Jie, Yang ..... 5/482
5,706,532 A * 1/1998 Kettenhofen ..... 5/413 R
5,713,090 A * 2/1998 Rodgers ..... 5/505.1
6,457,193 B1 * 10/2002 Li ..... 5/482

FOREIGN PATENT DOCUMENTS

GB 2074021 A * 10/1981
GB 2198940 A * 6/1988

* cited by examiner

*Primary Examiner*—Michael F. Trettel
(74) *Attorney, Agent, or Firm*—Michael L. Diaz

(57) ABSTRACT

A blanket providing enhanced ventilation to a person lying underneath the blanket. The blanket includes a sheet of material having a plurality of spaced apertures. Each aperture includes an opening allowing the passage of air through the blanket. The blanket may also include a reinforcing section embedded within a perimeter of the sheet of material. The reinforcing section may be a tube containing trapped air. In addition, the blanket may include supports connected to a collar section. The supports allow the blanket to be raised a specified distance above the person lying under the blanket. When the person releases the blanket, the blanket returns to its original position, lying over the person.

7 Claims, 4 Drawing Sheets

VENTILATED BLANKET

RELATED APPLICATIONS

This application is a continuation-in-part of U.S. patent application Ser. No. 09/923,700, entitled "Baby Blanket," filed Aug. 7, 2001, now U.S. Pat. No. 6,457,193, in the name of Hongbiao Li, which is hereby incorporated in its entirety by reference herein.

BACKGROUND OF THE INVENTION

1. Technical Field of the Invention

This invention relates to blankets and, more particularly, to a ventilated blanket allowing the passage of air through the blanket.

2. Description of Related Art

The use of a blanket provides warmth and comfort to a sleeping person. Co-pending U.S. patent application Ser. No. 09/923,700 ('700) describes a blanket for use on a baby to prevent the baby from removing the blanket from the baby's body. Although '700 discloses an effective way of preventing a baby from removing a blanket, '700 does not disclose a blanket which provides increased ventilation to a baby.

When a person covers a main portion of his body with a blanket, air is trapped underneath the blanket. This trapped air becomes stale and oftentimes, uncomfortably warm. In addition, it is well known that a person's skin must be constantly exposed to fresh air for maintaining healthy skin. Thus, positioning a blanket over a person, or a baby, is both uncomfortable and unhealthy. The baby instinctively attempts to remove the blanket. On the other hand, an adult has learned to endure the uncomfortable feeling of exposing a majority of the person's body to stale and unhealthy air. A blanket is needed which provides enhanced ventilation, while still allowing the person to properly cover his body.

In addition, the baby blanket disclosed in '700 discloses a mechanism for allowing the baby to lift the blanket, yet prevents the baby from removing the blanket from his body. To enhance the effectiveness of the disclosed blanket, air passageways may be utilized to functionally prevent the baby from removing the blanket. Thus, it would be a distinct advantage to have a blanket which prevents a person from removing the blanket from his body while sleeping. Additionally, it would be advantageous to have a blanket which provides enhanced ventilation to a person utilizing the blanket. It is an object of the present invention to provide such an apparatus.

SUMMARY OF THE INVENTION

In one aspect, the present invention is a blanket for use over a person. The blanket includes a sheet of material and a reinforcing section affixed to the sheet of material. The reinforcing section provides a substantial rigidity to a portion of the blanket. The blanket also includes a vertically raised section located on the sheet of material for raising a portion of the sheet of material away from a horizontal surface on which the sheet of material lies. The vertically raised section is extendable from the sheet of material. The blanket also includes a plurality of apertures spaced on the sheet of material for allowing passage of air through the sheet of material. The person is positioned under the blanket. The reinforcing section and the vertically raised section prevents the person from moving the blanket off the person's body while allowing restricted movement of the blanket. The apertures ventilate an underside of the blanket.

In another aspect, the present invention is a blanket for use over a person. The blanket includes a sheet of material and a plurality of apertures spaced on the sheet of material. Each aperture provides a passageway through the sheet of material. The blanket simultaneously provides cover to the person while allowing air to flow through the blanket for ventilation on an underside of the blanket.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
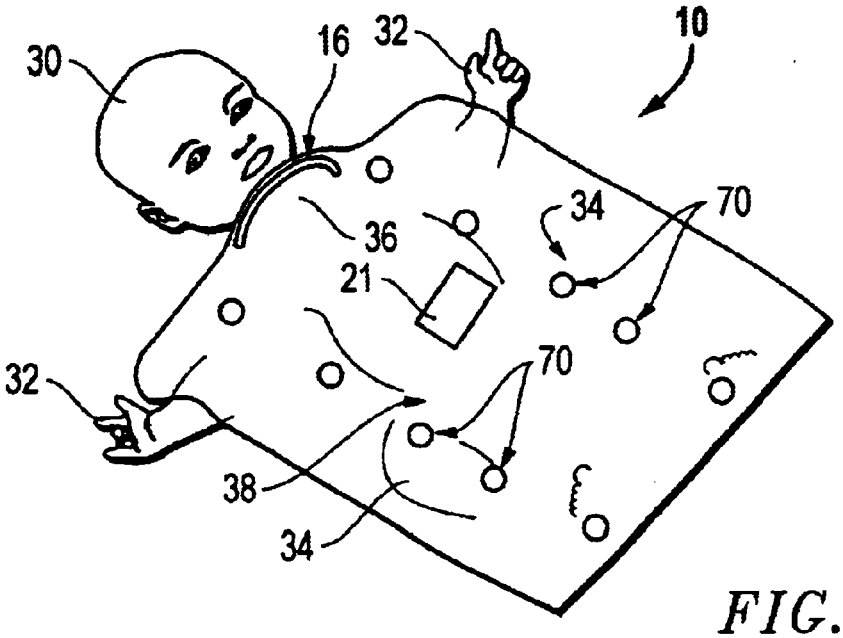
FIG. 1 is a top perspective view of a person lying underneath a blanket in the preferred embodiment of the present invention.

The present invention is a blanket providing enhanced ventilation to a person lying underneath the blanket, as well as preventing the person from inadvertently moving the blanket away from the person's body. FIG. 1 is a top perspective view of a person 30 lying underneath a blanket 10 in the preferred embodiment of the present invention. The blanket includes a flexible reinforcing section 12 (not shown in FIG. 1). The blanket may be constructed of any material. Typically the material is soft and flexible for the comfort of the baby. Preferably, the reinforcing section 12 is embedded within the interior portion of the blanket, thus removing the reinforcing section from view. However, in alternate embodiments of the present invention, the reinforcing section is affixed to an outer surface of the blanket. Preferably, the reinforcing section is located on a perimeter of the blanket. The reinforcing section may also taper inwardly toward a top portion of the blanket. Preferably, the reinforcing section is one or more tubes constructed of a flexible material such as a thin plastic. Within the interior of the tubes is trapped air.

In the preferred embodiment of the present invention, a vertically raised collar section 16 is located at the top portion of the blanket, in the general vicinity of the head and neck of the person. The reinforcing section is preferably constructed of a semi-flexible material providing some rigidity to the blanket to which it is attached. By providing a substantially rigid perimeter on the blanket, the person cannot remove the blanket away from the person's body without the blanket returning to its original configuration. However, the interior portion of the blanket still allows the baby to move.

The blanket 10 may also include a thermometer 21 indicating the ambient air temperature underneath the blanket. In order to insure that the person (baby) is kept at the proper temperature, the thermometer may be used to indicate to adults via a visual indication showing the temperature or an aural indicator, indicating when the temperature is above or below a desired temperature range. The use of a thermometer and associated visual and aural indicators are well known in the art of temperature measurement devices.

In the preferred embodiment of the present invention, the blanket includes a plurality of apertures 70 spread in various locations on the blanket. Preferably, the apertures are sufficiently spaced from each other to provide sufficient ventilation to a person's entire body located under the blanket.

Figure 2:
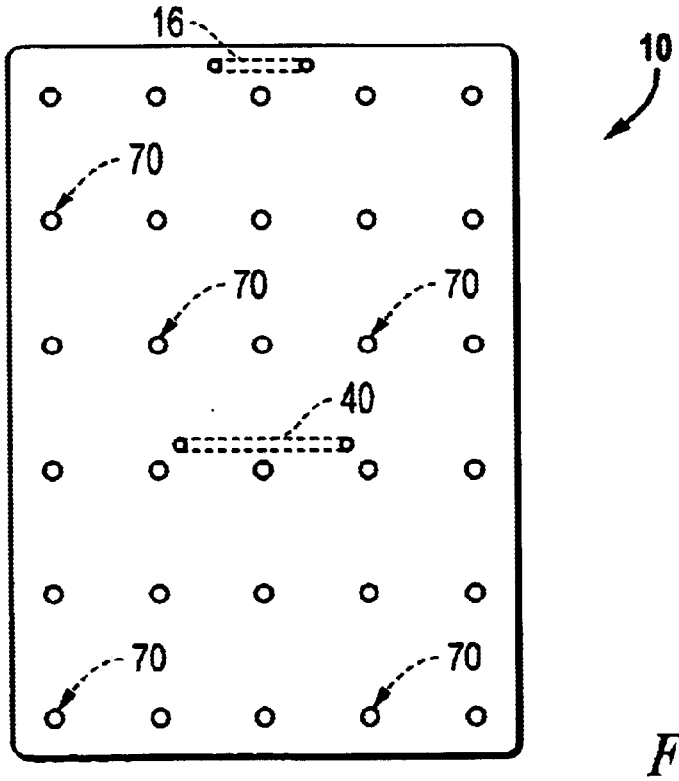
FIG. 2 is a top view of the blanket in a first alternate embodiment of the present invention.

FIG. 2 is a top view of the blanket in a first alternate embodiment of the present invention. It should be understood that the apertures may be any number and located anywhere on the blanket 10. As depicted in FIG. 2, more apertures 70 are located on the blanket. Additionally, the blanket may include one or more vertically raised sections. FIG. 2 depicts a vertically raised waist section 40. In alternate embodiments, the vertically raised sections may be located on other parts of the person's body, such as his arms or legs. It must be understood, that vertically raised sections may be located anywhere on the blanket and with any selected number of sections as desired to prevent the person from removing the blanket. In another alternate embodiment, the apertures may be utilized on any blanket, with or without the vertically raised sections.

Figure 3:
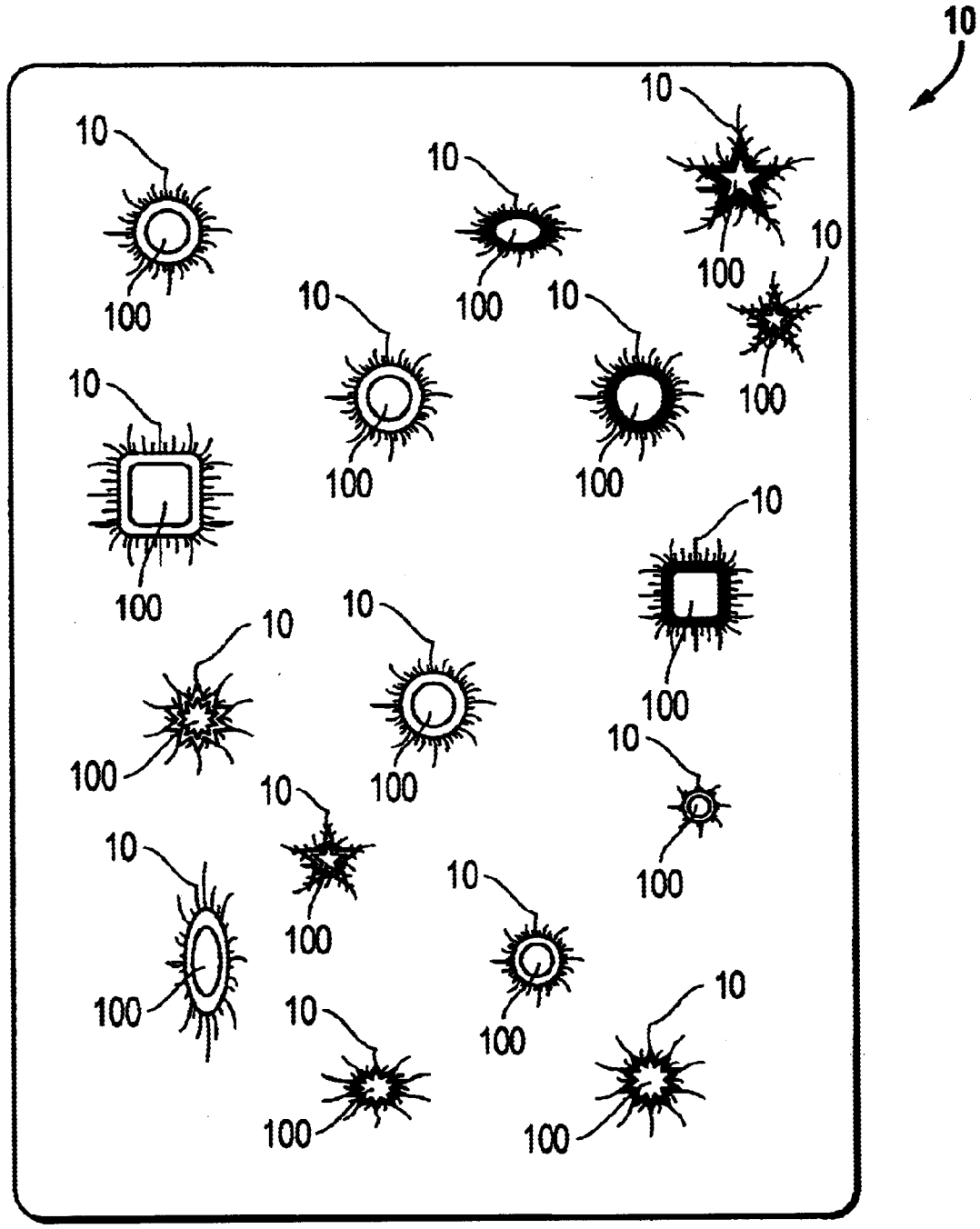
FIG. 3 is a top enlarged partial view of one aperture located on the blanket in the preferred embodiment of the present invention.

FIG. 3 is a top view of a plurality of apertures 70 located on the blanket 10 in the preferred embodiment of the present invention. The apertures may be affixed in any manner to the blanket which allows air to flow through the blanket. The aperture may also include a perimeter 100 to gather the material inwardly to facilitate a passageway through the blanket. Several shapes and sizes of apertures are depicted, although it should be understood that any size, number and shape of apertures may be utilized on the blanket 10. In addition, the aperture may be concealed by a covering, yet still allow the flow of air through the blanket. For example, a mesh covering may be utilized. In an alternate embodiment, the covering may including several perimeter openings allowing the passage of air around the covering into the aperture.

Figure 4:
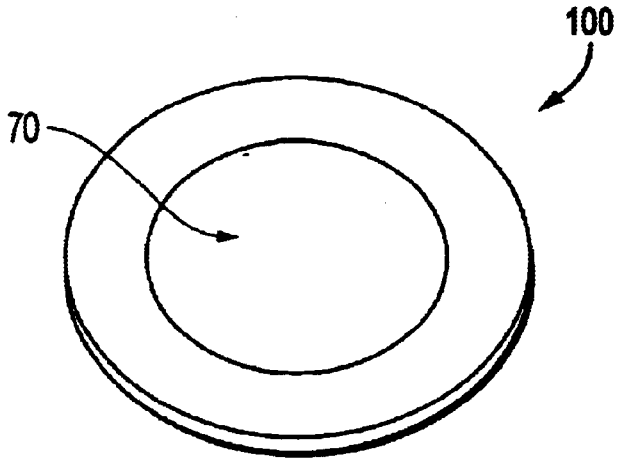
FIG. 4 illustrates the perimeter of FIG. 3 removed from the blanket.

FIG. 4 illustrates the perimeter 100 of FIG. 3 removed from the blanket. The perimeter may be any material, but preferably is a rigid or a partially rigid material. The perimeter is surrounded by the blanket. Within an interior portion of the perimeter is the aperture, which allows the passage of air.

Figure 5:
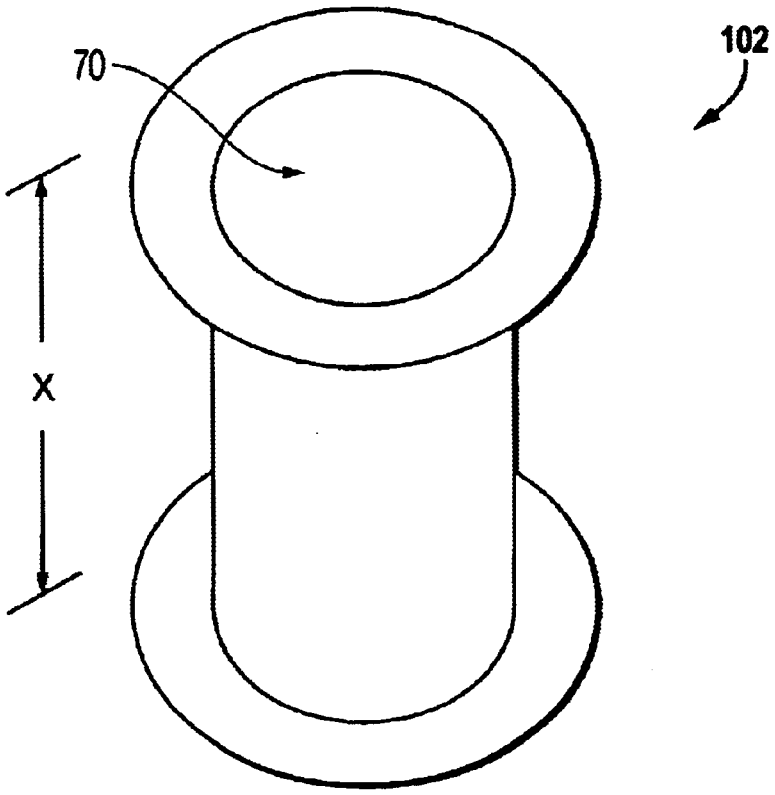
FIG. 5 is a front perspective view of a perimeter in a second alternate embodiment of the present invention.

FIG. 5 is a front perspective view of a perimeter 102 in a second alternate embodiment of the present invention. The perimeter may be sized and shaped in a variety of shapes which allows the passage of air from above the blanket to the area beneath the blanket. As depicted in FIG. 5, the perimeter 102 is cylindrical in shape having a height X. The perimeter 102 may be particularly effective for thick blankets.

Figure 6:
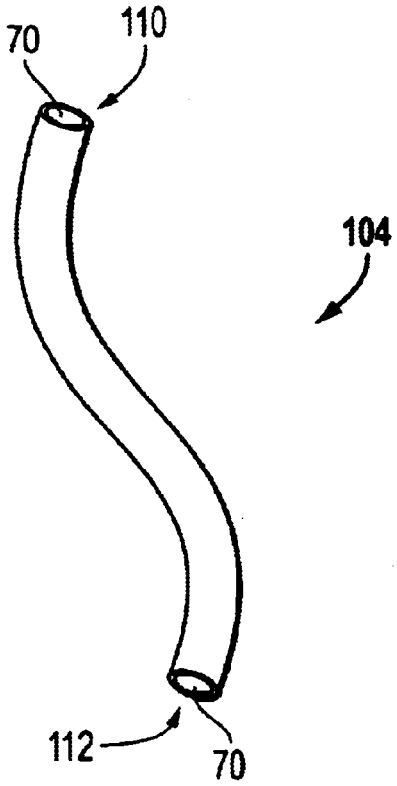
FIG. 6 is a front perspective view of a perimeter in a third alternate embodiment of the present invention.

It should be understood that the aperture may be configured in any shape and include alternative designs. FIG. 6 is a front perspective view of a perimeter 104 in a third alternate embodiment of the present invention. The perimeter 104 may include curves providing passageways leading from an upper end 110 to a lower end 112. Additionally, although the aperture is illustrated as circular, the aperture may be configured in alternate shapes, such as squares, triangles or stars.

Figure 7:
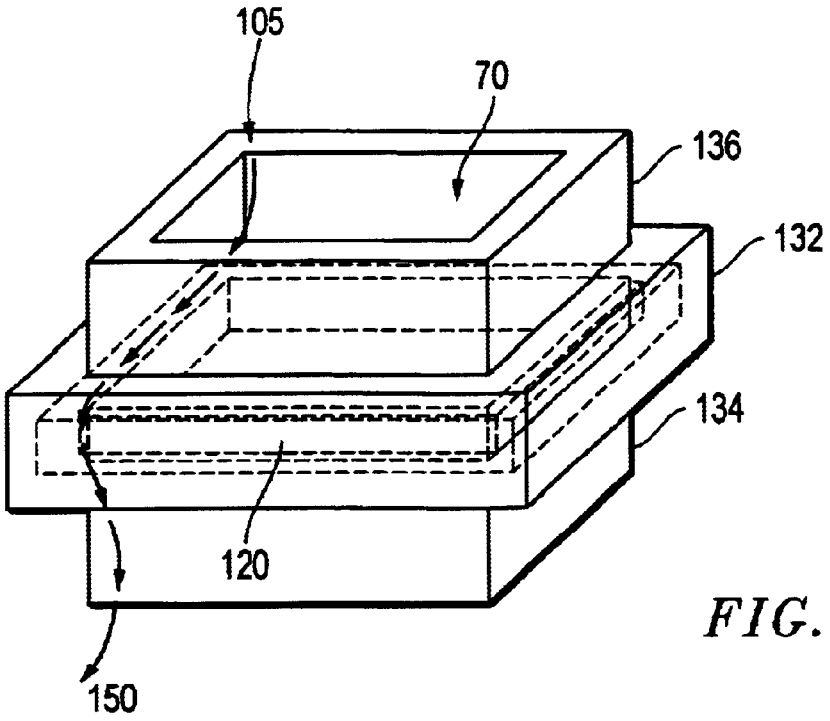
FIG. 7 illustrates a front partial cutaway perspective view of an aperture having a baffle in a fourth alternate embodiment of the present invention.

FIG. 7 illustrates a front partial cutaway perspective view of an aperture 70 having a baffle 120 in a fourth alternate embodiment of the present invention. As shown in FIG. 7, the aperture 70 includes an upper section 130, a middle section 132, and a lower section 134. Within an interior portion of the multiple sections, is the smaller interior baffle 120. Preferably, space is provided between the baffle and at least one section. As depicted, the baffle is located in the middle section and allows an airflow 150 to pass around the baffle and through the aperture 70. This configuration allows the airflow to pass through the blanket. However, rather than allow direct flow of the air, the air is diverted around the baffle.

With reference to FIGS. 1–7, the operation of the blanket 10 will now be explained. With apertures configured along the blanket 10, air is allowed to pass above and below the blanket, thus providing enhanced ventilation to the person lying under the blanket. The air flow may be directed around various passageways, such as illustrated in FIG. 6 or FIG. 7. The blanket 10 allows sufficient air to pass under the blanket, yet still comfortably covers the person.

As discussed above, the apertures may be utilized on any blanket to allow the passage of air through the blanket. The present invention provides such a passageway in an effective and efficient manner. The present invention enables fresh air to pass to an underside of the blanket while simultaneously providing cover to a person.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A blanket for use over a person, the blanket comprising:

a sheet of material;

a reinforcing section affixed to said sheet of material, said reinforcing section providing a substantial rigidity to a portion of the blanket;

a vertically raised section located on said sheet of material for raising a portion of said sheet of material away from a horizontal surface on which said sheet of material lies, wherein said vertically raised section includes a plurality of telescopically extendable legs, the legs being positioned on the horizontal surface; and a plurality of apertures spaced on said sheet of material for allowing passage of air through said sheet of material;

whereby the person is positioned under the blanket, said reinforcing section and said vertically raised section preventing the person from moving the blanket off a body of the person while allowing restricted movement of the blanket and said plurality of apertures ventilating an underside of the blanket.

2. The blanket of claim 1 wherein said reinforcing section is a flexible tube having air trapped within the tube.

3. The blanket of claim 1 wherein each aperture includes a perimeter providing a passageway through said sheet of material.

4. The blanket of claim 3 wherein each perimeter is affixed to said sheet of material.

5. The blanket of claim 4 wherein each perimeter has a depth at least as long as a thickness of said sheet of material.

6. The blanket of claim 1 wherein the reinforcing section is embedded in an interior portion of the sheet of material.

7. The blanket of claim 1 wherein the reinforcing section is affixed to an exterior surface of said sheet of material.

* * * * *